United States Patent [19]

Salata

[11] 4,053,160

[45] Oct. 11, 1977

[54] GOLF CLUB SWING TRAINING DEVICE

[76] Inventor: Joseph M. Salata, 4716 Behrwald Ave., Cleveland, Ohio 44144

[21] Appl. No.: 666,187

[22] Filed: Mar. 12, 1976

[51] Int. Cl.[2] ..... A63B 69/36

[52] U.S. Cl. ..... 273/186 A; 273/186 C; 273/194 R; 273/163 A

[58] Field of Search ..... 273/186 A, 194 A, 194 R, 273/163 R, 163 A, 164, 194 B, 193 R, 35 A; 35/29

[56] References Cited

U.S. PATENT DOCUMENTS

| | | | |
|---|---|---|---|
| 1,556,062 | 10/1925 | Baugh | 273/163 R X |
| 2,463,200 | 3/1949 | Pitzer | 273/194 R X |
| 2,463,798 | 3/1949 | Paisley | 273/163 R |
| 3,118,678 | 1/1964 | Rohr | 273/194 R X |
| 3,170,698 | 2/1965 | Schoeffler et al. | 273/194 A X |
| 3,198,525 | 8/1965 | Smith | 273/194 A X |
| 3,667,761 | 6/1972 | Palotsee | 273/194 A X |

*Primary Examiner*—George J. Marlo

*Attorney, Agent, or Firm*—Woodling, Krost, Granger & Rust

[57] ABSTRACT

A golf putting device is disclosed for practicing putting a golf ball toward a hole by a player with a golf putter club having a putter shaft and a putter face. The invention comprises an alignment member being mounted to the putter shaft to extend in front of and being substantially normal to the plane of the putter face. A reflector element is mounted to be behind the plane of the putter face. The relative position of the alignment member and the reflector element enables the player to observe the alignment member being simultaneously superimposed over the ball and over the reflection of the hole in the reflector element to establish the putter face to be normal to a line extending between the golf ball and the hole. The forward extension of the alignment member is superimposed over the golf ball during substantially all of the putting stroke enabling the player to practice maintaining the putter face normal to the line extending between the golf ball and the hole.

10 Claims, 12 Drawing Figures

GOLF CLUB SWING TRAINING DEVICE

BACKGROUND OF THE INVENTION

1. Field of the Invention

This invention relates to amusement devices and games and more particularly to practice devices with indicators responsive to the club swing.

2. Description of the Prior Art

The prior art has known many devices for aiding a golf player improve the player's putting ability. Most of the prior art devices were directed to means for aiming the putter face relative to the golf hole. Some in the prior art have used mirrors to align the putter face to be normal to a line extending between the ball and the golf hole. Others in the prior art have used simple wire sights to accomplish this same end. Others in the prior art have incorporated members extending from a golf club shaft for positioning the face of the club relative to the target and for positioning the player's body relative to the golf club. These devices did not aid the player in improving the player's golfing stroke or swing but merely aided the player aim the golf club. If the golf stroke or swing of the player was defective then the player would still miss the target although the club was initially correctly aligned. Some in the prior art have used a system having a mirror secured to the putter to reflect light at a screen having a chart. A camera photographed the movement of the light beam across the screen for analyzing the golf stroke. This invention was not readily usable and was expensive due to the cost of the photographic film required for the camera.

Therefore, it is an object of this invention to provide a golf device for putting a ball toward a target having an alignment member for aligning the putter face to be normal to a line extending between the ball and the target.

Another object of this invention is to provide a golf putting device for putting a ball toward a target including means for indicating the alignment of the putter face relative to a line extending between the ball and the target during substantially all of the putting stroke.

Another object of this invention is to provide a golf device for putting a ball toward a target including a reflector element and an aiming mark established to be superimposed over the reflection of the target in the reflector element to enable the putter face to be aligned normal to a line extending between the ball and the target.

Another object of this invention is to provide a golf putting device for putting a ball toward a target having a three point alignment system including (1) the golf ball centered on the club face, (2) an alignment member superimposed on the center of the golf ball, and (3) the alignment member superimposed on the center of the target in the reflection of a reflector element.

Another object of this invention is to provide a golf putting device for putting a ball toward a target which is readily adaptable to existing golf putter clubs.

Another object of this invention is to provide a golf putting device for putting a ball toward a target which enables one to self teach a preferred putting stroke.

SUMMARY OF THE INVENTION

The invention may be incorporated in a golf device for putting a ball toward a target with a golf putter club having a putter face, comprising in combination, means for aiming the putter club at the target to align the plane of the putter face substantially normal to a line extending between the putter face and the target, and means for indicating the alignment of the putter face relative to said line extending between the putter face and the target during at least a portion of the putting stroke.

The invention may also be incorporated in a golf device for putting a ball toward a target by a player with a golf putter club having a putter shaft and a putter face, comprising in combination, an alignment member, a reflector element, means for mounting said reflector element relative to said alignment member, and mounting means for mounting said alignment member to the putter shaft with said alignment member being contained within a plane substantially perpendicular to the plane of the putter face and simultaneously superimposed over the ball and over the reflection of the target in said reflector element to enable the player to practice maintaining said alignment member superimposed over the ball during at least a portion of the putting stroke.

Other objects and a fuller understanding of this invention may be had by referring to the following description and claims, taken in conjunction with the accompanying drawings.

DESCRIPTION OF THE PREFERRED EMBODIMENT

Figure 1:
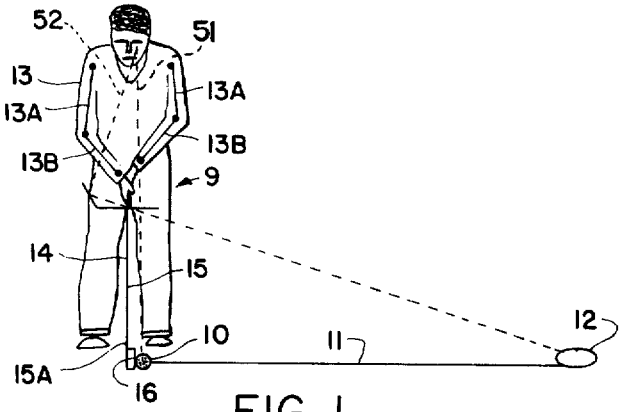
FIG. 1 illustrates a golf player practicing putting using the novel golf putting device.
Figure 4:
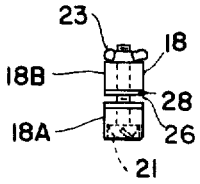
FIG. 4 is a side view of a portion of the invention shown as a member for securing the device to the putter shaft.
Figure 5:
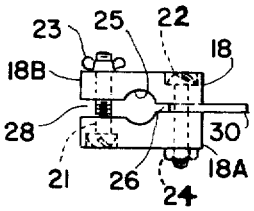
FIG. 5 is a top view of the member shown in FIG. 4.
Figure 2:
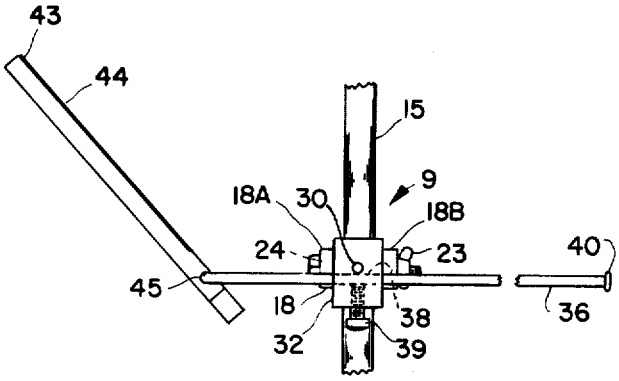
FIG. 2 is a side view of the invention secured to a shaft of a golf putter club.
Figure 3:
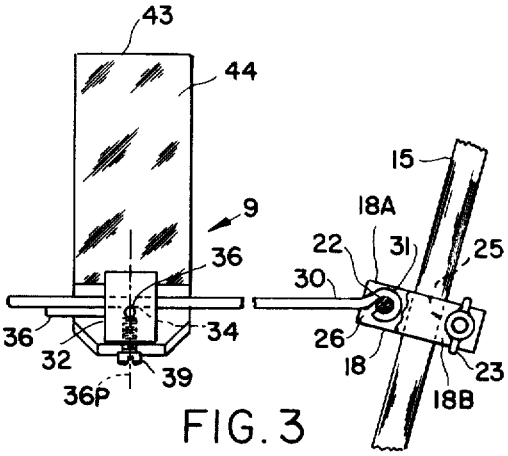
FIG. 3 is a front view of the invention shown in FIG. 2.

FIGS. 1-3 illustrate various views of a golf device 9 for putting a golf ball 10 toward a target shown as a golf hole 12 by a golf player 13 with a golf putter club 14 having a putter shaft 15 and a putter face 16. The invention includes a shaft securing device 18 shown in FIGS. 2-5 as a split block having portions 18A and 18B secured to one another by machine screws 21 and 22 in cooperation with nuts 23 and 24. The internal portion of the shaft securing device 18 defines a semi-circular aperture 25 with a narrow slot 26 and a wide slot 28 extending between the edges of the shaft securing device 18. The narrow slot 26 in cooperation with machine screw 22 and nut 24 secures a support member 30 to extend outwardly from the putter shaft 15.

The nut 23 is shown as a wing nut to facilitate easy removal of the machine screw 21. This enables the generally narrower bottom portion 15A of the putter shaft 15 to be slipped through the wide slot 28 to aperture 25. The machine screw 21 and nut 23 are then reinstalled and the shaft securing device 18 is raised to the position show in FIG. 1. Pressure exerted by tightening wing nut 23 causes aperture 25 to engage the outer surface of the putter shaft 15 to secure the member 18 relative to the putter shaft 15. The support member 30 may be adjusted to be substantially horizontal as shown in FIGS. 2 and 3 irrespective of the slant of the putter shaft 15 as shown in FIG. 3. The support member 30 is frictionally held in place by contact with portions 18A and 18B which friction is controlled in part by screw 22 and nut 24. The member 18 is adjusted and secured by nut 23 such that the support member 30 is substantially parallel to the face 16 of the putter 14. Loop 31 on the support member 30 enables the support member 30 to be pivoted about screw 22.

A coupling member 32 receives the support member 30 in an aperture 34 with the coupling member 32 receiving an alignment member 36 and an aperture 38. Apertures 34 and 38 establish the alignment member 36 to be perpendicular to the support member 30. Accordingly, once the support member 30 is established parallel to the putter face 16 then the alignment member 36 will be contained in a plane 36P perpendicular to the plane 16P of the putter face 16. The apertures 34 and 38 are in communication with one another enabling a machine screw 39 which is threaded into the coupling member 32 to exert pressure on both the support member 30 and the alignment member 36. Screw 39 may be adjusted such that the support member 30 and the alignment member 36 maintain their relative position and yet are movable enabling both linear and angular adjustment therebetween.

The alignment member 36 receives an aiming mark 40 at one end thereof and receives a reflector element 43 shown as a plastic mirror having a reflecting surface 44 at the other end of the alignment member 36. The reflector element 43 includes an aperture 45 having friction fit with the alignment member 36 to enable angular adjustment of the reflector element 43.

Figure 6A:
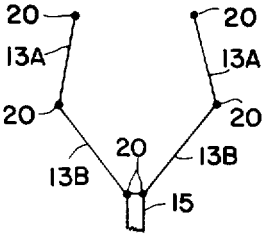
FIG. 6A is a skeleton view of the arm position of the golf player shown in FIG. 1.
Figure 7A:
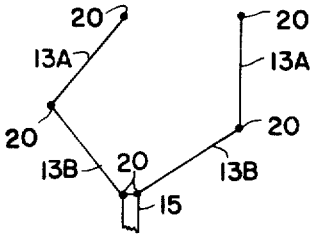
FIG. 7A is a skeleton view of the arm position of the golf player shown in FIG. 1 in the back stroke position.
Figure 8A:
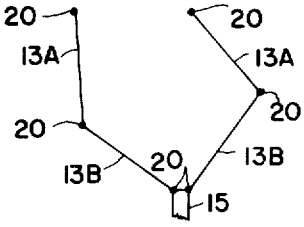
FIG. 8A is a skeleton view of the arm position of the golf player in FIG. 1 in the forward stroke position after contact with the ball.

The operation and use of the instant invention is in part predicated on the theory that the preferred putting stroke comprises the putter face 16 being maintained normal to a line 11 extending between the golf hole 12 and the golf ball 10 and maintained at a given distance above the ground level. The player 13 shown in FIG. 1 may be structurally considered to have upper arm members 13A and lower arm members 13B connected by pivot joints 20 such as the shoulder, elbow and wrist joints. FIGS. 6A, 7A and 8A are simplified structural diagrams of the upper arms 13A and the lower arms 13B of the player 13 relative to the putter shaft 15 in three different positions of the preferred putting stroke. The preferred putting stroke requires the arms to move in a single plane which is contained in the plane of the drawings. If a player maintains the plane of the putter face 16 normal to line 11 and concomitantly maintains the putter face 16 a given distance from the ground then by necessity the upper and lower arms 13A and 13B will move as illustrated in FIGS. 6A–8A. Accordingly, the player must practice maintaining the arm movements shown in FIGS. 6A–8A within a single plane. The teaching of the preferred putting stroke through the disclosed device, is one of the significant contributions to the putting art of the instant invention.

Figure 6B:
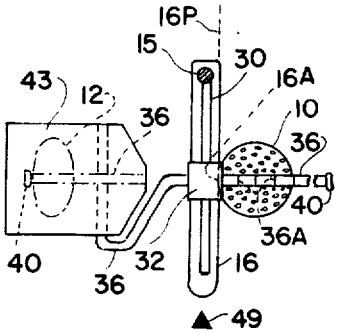
FIG. 6B is a top view of the putter head and the golf ball as observed by the player shown in FIG. 1 when the player's arms are in the position shown in FIG. 6A.

FIGS. 6B–8B are top views of the putter head and the golf ball 10 as observed by the player 13 during the respective positions of the putting stroke shown in FIGS. 6A–8A. FIGS. 1, 6A and 6B illustrate the initial stance position wherein the player 13 aligns the ball 10 to be adjacent the center 16A of the putter face 16 sometimes referred to as the "sweet spot" of the putter face 16. The ground marker 49 bisects the putter club 14 and the player 13. This is the first alignment required by the player 13. The player 13 then aligns the alignment member 36 to be superimposed over the center of the golf ball 10 when sighting downwardly along ray 51. This is the second alignment required by the player 13. The player 13 then adjusts the putter club 14 to enable the reflection in the reflector element 43 to superimpose the aiming mark 40 or a portion of the alignment member 36 over the center of the target or hole 12 when sighting downwardly along ray 52. This is the third alignment required by the player 13 in FIGS. 1 and 6. After the three aforementioned alignments have been simultaneously achieved, the player 13 may then stroke the putter while keeping the player's arm movement restricted into a single plane to maintain the putter face 16 normal to the line 11.

Figure 7B:
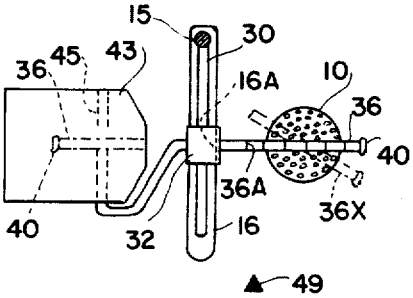
FIG. 7B is a top view of the putter head and the golf ball as observed by the golf player shown in FIG. 1 when the player's arms are in the position shown in FIG. 7A.

FIGS. 7A and 7B illustrate the backstroke of the putting stroke with the player's arms 13A and 13B being maintained within a single plane as indicated by the alignment member 36 still being superimposed over the center of the golf ball 10. An incorrect putting stroke caused by the player's arms not being maintained within a single plane will be indicated by the alignment member 36 being offset from the center of the golf ball 10 as shown by the phantom position 36X. The alignment member 36 extends sufficiently in front of the plane of the putter face 16P to enable the alignment member 36 to be superimposed over the golf ball 10 for virtually all of the putting stroke. Accordingly, the player can detect an imperfect putting stroke by merely viewing the motion of the alignment member 36 relative to the ball 10. Upon movement of the putter face 16 in the backstrode as shown in FIG. 7, the target 12 no longer appears in the reflection of the mirror 43. The reflection of the target 12 during the backstroke is not necessary since the player need only maintain the alignment member 36 superimposed over the ball 10 to maintain the putter face 16 properly aligned relative to the target 12. The reflecting aiming devices in the prior art did not have any means to maintain alignment of the putter face 16 relative to the target during the backstroke. If the player used a defective putting stroke, the ball would not hit the target although initially aligned in the prior art aiming devices. The instant invention enables the player to maintain alignment of the putter face 16 relative to the target 12 not only in the initial position (FIGS. 1 and 6), but also in the backstroke position (FIG. 7), and in the forward stroke position (FIG. 8).

Figure 8B:
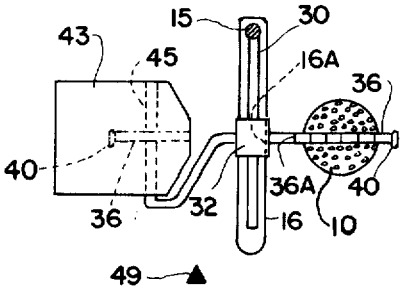
FIG. 8B is a top view of the putter head and the golf ball as observed by the golf player shown in FIG. 1 when the player's arms are in the position shown in FIG. 8A.

FIGS. 8A and 8B illustrate the putting forward stroke after the ball has been contacted by the moving putter face 16 as shown by the relative position between the ball 10 and the ground marker 49. The ball 10 is now rolling along line 11 toward the hole 12. The image of the reflection of the target 12 does not appear in the reflector element 43 but the alignment member 36 is superimposed over the golf ball 10.

The instant invention enables one to practice putting the preferred putting stroke by maintaining the movement of the upper and lower arms 13A and 13B in planes as illustrated in FIGS. 6A–8A. Once the three point alignment is established as shown in FIG. 6A the player need only maintain the player's arm movements within a single plane. By maintaining the alignment member 36 superimposed over the golf ball 10 during the putting stroke, the player 13 can develop this preferred putting stroke and maintain the arm movements within a single plane. Graduated marks 36A may be included on the alignment member to help determine the amount of back stroke for a given putting distance. The player may then estimate the amount of backstroke by the mark 36A superimposed over the ball 10.

Figure 9:
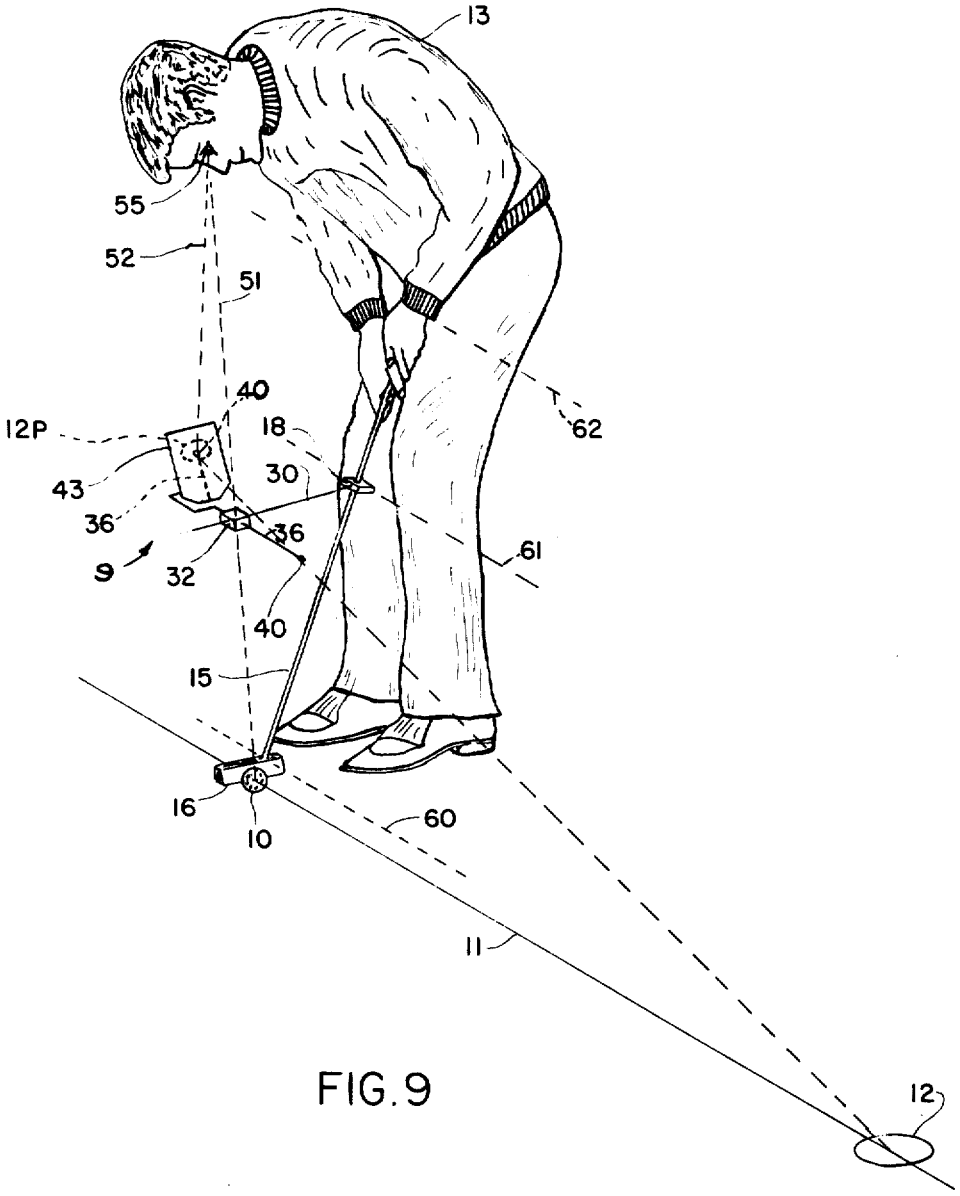
FIG. 9 is an enlarged elevated view of the golf player practicing putting as shown in FIG. 1.

FIG. 9 is a partial side and front elevated view of the player 13 shown in FIG. 1. The player 13 initially addresses the ball 10 and adjusts the coupling member 32 such that the eye 55 of the player 13, the coupling member 32 or a portion of the alignment member 36 and the ball 10 lie in a straight line as shown by ray 51. This adjustment will vary depending upon the stance of the player 13. The reflector element 43 is then adjusted such that the player's eye 55 will see the target 12 reflecting in the reflector element 43 along ray 52. Once the coupling member 32 and the reflector element 43 have been adjusted, no further adjustment is required of the device 9. The putter face 16 is then aligned relative to the line 11 by centering the reflection of the alignment member 36 or the aiming mark 40 over the center of the reflection 12P of the target 12 in the reflecting element 43. After the above adjustments and alignment have been made, the player 13 merely maintains the alignment member 36 over the center of the golf ball 10 during the complete putting stroke. The putter is then restricted to movement along lines 60 and 61 which are parallel to the line 11 extending between the ball 10 and the target 12. In like fashion the hands and lower arms of the player 13 are restricted to movements along line 62 and as long as the player 13 maintains the alignment member 36 superimposed over the center of the ball 10, then the respective portions of the putter club and lower arms will move along lines 60–62.

The alignment set forth in the instant invention may be considered to be a six point alignment comprising a vertical three point alignment operation and a horizontal three point alignment operation. The vertical three point alignment operation comprises (1) the alignment of the eye 55, (2) the coupling member 32 or a portion of the alignment member 36 and (3) the golf ball 10. The horizontal three point alignment operation comprises the alignment of (1) the eye 55, (2) the reflection of the alignment member 36 or the aiming mark 40 and (3) the reflection of the target 12.

The instant invention enables one to align the putter face 16 relative to the hole 12 and to observe defects in the preferred putting game. This invention contributes a simple device which may be secured to most any existing putter club and which readily analyzes and indicates to the player the defects in the player's putting stroke.

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A golf device for aiming a ball toward a target by a player with a golf club having a shaft and a face, comprising in combination:
   an alignment member;
   a reflector element;
   first means mounting said reflector element relative to said alignment member;
   second mounting means for mounting said alignment member to the club shaft with said alignment member being disposed in a plane containing a line substantially normal to the plane of the club face;
   said first and second mounting means establishing concurrently first and second three point alignment paths, with said first three point alignment path being the player's eye, the ball and the alignment member therebetween superimposed on the ball as viewed by the player;
   and said second three point alignment path being the target, the player's eye and the alignment member therebetween and pointing toward the target with this path being bent at about a right angle by said reflector element.

2. A golf device as set forth in claim 1, wherein said first means mounting said reflector element includes adjustable mounting means.

3. A golf device as set forth in claim 1, wherein said second mounting means includes a support member;
   means for securing said support member to the club shaft to extend outwardly from the club shaft and substantially parallel to the club face;
   and means securing said alignment member to be perpendicular to said support member.

4. A golf device as set forth in claim 1, wherein said second mounting means enables said alignment member to be superimposed on the center of the ball as viewed by the player when the ball is addressed by the player.

5. A golf device as set forth in claim 4, wherein said second mounting means includes securing means providing an adjustable friction fit with a portion of the club shaft.

6. A golf device as set forth in claim 1, wherein said first and second mounting means enables at least a portion of the reflection of said alignment member to be superimposed on the center of the reflection of the target as viewed by the player in said reflector element when the ball is addresed by the player.

7. A golf device as set forth in claim 1, wherein said alignment member extends forwardly of the plane of the club face enabling said alignment member to be superimposed on the ball as viewed by the player during the club back stroke and during at least a portion of the club forward stroke.

8. A golf device as set forth in claim 1, wherein said alignment member includes an alignment rod having an aiming mark at one end thereof.

9. A golf device as set forth in claim 1, wherein said reflector element is located behind the plane of the club face and said alignment member extends in front of the plane of the club face.

10. A golf device as set forth in claim 1, including marking means established on said alignment member to be superimposed on the ball as viewed by the player for enabling the player to estimate the amount of club backstroke.

* * * * *